US005823670A

United States Patent [19]

Rushing et al.

[11] Patent Number: 5,823,670

[45] **Date of Patent: *Oct. 20, 1998**

[54] CHEMICAL DELIVERY AND ON-SITE BLENDING SYSTEM FOR PRODUCING MULTIPLE PRODUCTS

[75] Inventors: J. Mitchell Rushing, Greenville; Terry L. Scruggs, Taylors; John J. Malone, Simpsonville, all of S.C.

[73] Assignee: Calgon Corporation, Pittsburgh, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 314,393

[22] Filed: Sep. 28, 1994

(Under 37 CFR 1.47)

Related U.S. Application Data

[63] Continuation-in-part of Ser. No. 153,860, Nov. 17, 1993.

[51] Int. Cl.[6] ..... B01F 15/04

[52] U.S. Cl. ..... 366/152.1; 366/162.1; 366/348; 137/3

[58] Field of Search ..... 366/171.1, 152.1, 366/154.1, 162.1, 160.1, 165.5, 173.1, 348, 152.4; 222/1, 132, 145.5, 145.6; 134/93, 94.1, 99.2; 137/3

[56] References Cited

U.S. PATENT DOCUMENTS

| | | | |
|---|---|---|---|
| 3,543,787 | 12/1970 | Tepper | 222/132 |
| 3,930,598 | 1/1976 | Slagle | 222/132 |
| 4,353,482 | 10/1982 | Tomlinson et al. | 222/1 |
| 4,403,866 | 9/1983 | Falcoff et al. | 366/152.1 |
| 4,433,917 | 2/1984 | Mendel et al. | 366/160.1 |
| 4,525,071 | 6/1985 | Horowitz et al. | 366/152.1 |
| 4,820,450 | 4/1989 | Wile et al. | 134/14 |
| 4,845,965 | 7/1989 | Copeland et al. | 134/93 |
| 4,872,763 | 10/1989 | Higuchi et al. | 366/152.1 |
| 4,877,522 | 10/1989 | Toei et al. | 366/152.1 |
| 4,889,433 | 12/1989 | Pratt | 366/141 |
| 4,918,659 | 4/1990 | Bragg et al. | 366/132 |
| 4,964,185 | 10/1990 | Lehn | 134/93 |
| 4,964,732 | 10/1990 | Cadeo et al. | 366/152.1 |
| 4,981,024 | 1/1991 | Beldham | 222/2 |
| 5,027,267 | 6/1991 | Pitts et al. | 366/152.1 |
| 5,259,557 | 11/1993 | Spriggs et al. | 222/132 |
| 5,332,311 | 7/1994 | Volk, Jr. et al. | 366/177.1 |
| 5,340,210 | 8/1994 | Patel et al. | 366/132 |
| 5,452,954 | 9/1995 | Handke et al. | 366/152.1 |

FOREIGN PATENT DOCUMENTS 0474869 3/1992 European Pat. Off. .

OTHER PUBLICATIONS

DEMA, Cleaning Centers, p. 3, model 611, 611–1 and 611–2.

DEMA, Bulletin No. 93002, BLend Safe, model 660–4 and 660.

DEMA, Bulletin No. 93003, Blend Center, model 633, 681–3.

DEMA, Bulletin No. 93004, Cleaining Center, model 636.

*Primary Examiner*—Tony G. Soohoo

*Attorney, Agent, or Firm*—Reed Smith Shaw & McClay

[57] ABSTRACT

A chemical delivery and on-site blending system for producing multiple products is provided. Generally, chemical subcomponents are fed to a chemical blending system for making a multitude of products at the facility where the products are to be used. Also, a water line is connected to the system for blending with the subcomponents and for rinsing the system equipment. A microprocessor controls a series of inlet valves, a feed pump, and a mixer for formulating the products in a mixing tank. A flow meter monitored by the microprocessor measures the amounts of ingredients entering the tank. Once formulated, a product is discharged from the tank by a discharge pump also controlled by the microprocessor. Included with the system is a timed rinse cycle which rinses the tank after the product has been discharged. In one application, the chemical delivery and on-site blending system can be used to form a selected plurality of chemical cleaning products for use in cleaning and treating devices and machinery used in the manufacture of paper products.

8 Claims, 8 Drawing Sheets

CHEMICAL DELIVERY AND ON-SITE BLENDING SYSTEM FOR PRODUCING MULTIPLE PRODUCTS

CROSS REFERENCE TO RELATED APPLICATION

This application is a continuation-in-part of co-pending U.S. application Ser. No. 08/153,860 filed Nov. 17, 1993, which is fully incorporated herein by reference thereto.

BACKGROUND OF THE INVENTION

The present invention relates generally to a delivery and a chemical blending system for blending chemical subcomponents on site into a multitude of chemical products. Also included is a process incorporating the chemical blending system.

In the chemical industry, suppliers typically offer a variety of products designed to target a specific market. Consequently, it is not uncommon for a chemical supplier to supply a variety of related chemical products to one particular customer. Many of these chemical products, although used for different applications or in different chemical processes, contain many of the same components. For instance, water is commonly added to most products as a diluting agent.

In supplying these products, a large proportion of their cost is for their transportation and delivery. Chemical suppliers and distributors, therefore, have been searching for economically effective ways of delivering their chemical products. For instance, some suppliers transport each of their chemical products in bulk. The products are delivered to a facility in large tanks on trucks or rail cars and emptied into holding tanks operated by the customer. In this situation, fewer trips to each customer are necessary. However, each product must be shipped separately and the customer is burdened with maintaining several large tanks. Also, if the product being shipped has been diluted with water, the customer is charged indirectly for the transportation of that water when paying the delivery cost for the product.

Other chemical suppliers ship their products in 55-gallon drums. The customer, therefore, would not have to maintain large receiving tanks. However, packaging costs can be very high. The drum can represent a significant portion of the cost of the product. Also, the customer is still paying for the transportation of water when water is a constituent of the product. Further, the disposal of emptied 55-gallon drums can be very expensive. Depending upon their chemical contents, a used drum can be labeled as a regulated waste. As such, an emptied drum would have to be sent to a specialized facility for disposal.

Further, whether shipping products in bulk or in 55-gallon drums, past delivery methods generally required that the chemical products be shipped premixed and in relatively large quantities. As such, the products generally are stored for long periods of time before use. During this lag time, some chemical products can tend to separate out into their separate chemical components. In order to cure this deficiency, emulsifiers and coupling agents are added to the products, which not only increases the cost of the products, but also the cost of their transportation.

In order to alleviate the transportation costs of shipping diluted products, some chemical distributors have transported their products in a more concentrated state. After delivery, the customer can then add water to the concentrated subproduct to arrive at a desired dilution. Typically, water is injected into a line as the chemical is being used. Problems have been encountered, however, in maintaining the correct water to product ratio and in allowing for adequate mixing of the solution. Further, although shipping concentrated products, the distributor still must transport each product separately.

Thus, chemical suppliers have attempted to find an economical and efficient way to transport their products. However, shortcomings of the prior art are numerous. Specifically, the prior art fails to provide a cost effective system for delivering several related chemical products to a particular customer. Related products generally are products that contain common ingredients and are often used to target a specific market.

SUMMARY OF THE INVENTION

The present invention recognizes and addresses the foregoing disadvantages, and others, of prior art for supplying chemicals to customers.

Accordingly, it is an object of the present invention to provide a process for supplying chemical products to customers.

It is another object of the present invention to provide a chemical blending system.

It is a further object of the present invention to provide a chemical blending system that can blend solutions on site for customer use.

It is another object of the present invention to provide a process for blending chemical subcomponents into desired chemical products on site without having to transport each particular product individually.

It is still another object of the present invention to supply concentrated chemical subcomponents to a customer, whereas the customer supplies water for mixing with the subcomponents.

It is another object of the present invention to provide a fully automated chemical blending system that can blend predetermined quantities of chemical subcomponents and water into multiple products for use in particular applications.

It is another object of the present invention to provide an economical and efficient process for supplying a plurality of chemical products to a paper manufacturer.

Additional objects and advantages of the invention are set forth in or will be apparent to those of ordinary skill in the art from the detailed description which follows. Also, it should be further appreciated that modifications and variations to this specifically illustrated and discussed features or materials hereof may be practiced in various embodiments and uses of this invention without departing from the spirit and scope thereof, by virtue of present reference thereto. Such variations may include, but are not limited to, substitution of equivalent means and features or materials for those shown or discussed, and the functional or positional reversal of various parts, features, or the like. Still further, it is to be understood that different embodiments, as well as different presently preferred embodiments of this invention may include various combinations or configurations of presently disclosed features or elements, or their equivalents (including combinations or configurations thereof not expressly shown in the figures or stated in the detailed description). One such exemplary embodiment of the present invention relates to a chemical delivery and on-site blending system for forming a plurality of preselected chemical products at a use site. The present invention also encompasses a process for using the chemical delivery and on-site blending system.

Preferably, the process is for supplying a plurality of preselected chemical products to a determined use site by forming the chemical products at the site without having to deliver them individually. The process includes supplying to a determined use site a plurality of preselected respective chemical subcomponents for blending into a plurality of preselected chemical products. The subcomponents are generally in a chemically concentrated state. As used hereinafter, a chemically concentrated state refers to a chemical in which water or any other diluent is added before the chemical is at a desired strength for use.

The subcomponents are preselected so that a set number of the preselected subcomponents can yield through controlled on-site mixing a predetermined number of preselected chemical products in which the predetermined number of chemical products is higher than the set number of chemical subcomponents. Predetermined measured amounts of certain of the subcomponents are fed into a mixing tank for blending into a user selected one of the respective chemical products. The subcomponents are mixed for a predetermined interval of time for forming the user selected chemical product.

The on-site formed product is then discharged from the mixing tank for selective storage and use of the on-site product at the site. Formation of the on-site, user selected chemical product from the respective chemical subcomponents is automated by a central processing means having a user input control panel so that an on-site user can activate the process for automatically forming the chemical products.

The process can further include the step of feeding a predetermined measured amount of water into the mixing tank with the respective chemical subcomponents. The water preferably comes from a water source at the site and, therefore, is not transported with the chemical subcomponents. Further, the process can include the step of rinsing the mixing tank with water after one of the preselected products has been formed and discharged from the tank. The water again preferably comes from a water source located at the use site.

The chemical subcomponents can be pumped into the mixing tank and are fed to the mixing tank one at a time. The central processing means receives information from a flow detecting instrument for determining the predetermined measured amounts of the chemical subcomponents.

In another embodiment, the process for forming a plurality of preselected chemical products at a determined site for use from a plurality of respective chemical subcomponents is fully automated and includes a programmable, electrical processing means having a user input control panel. A user activates one of a plurality of product select switches for forming one of the corresponding chemical products. The process includes supplying to a determined use site a plurality of preselected respective chemical subcomponents for blending into a plurality of preselected chemical products. The subcomponents are generally in a chemically concentrated state. Predetermined measured amounts of certain of the subcomponents are fed into a mixing tank for later blending into a user selected one of the respective chemical products.

A predetermined measured amount of water is also fed into the mixing tank. The water preferably comes from a water source at the use site and, therefore, is not transported with the chemical subcomponents. The subcomponents and the water are mixed for a predetermined interval of time for forming the user selected chemical products. The on-site formed product is then discharged from the mixing tank for selectively storing and using the product at the site. From the process, more chemical products are formed than there are respective chemical subcomponents such that a lesser number and quantity of chemicals are transported to the use site than if each of the chemical products were transported individually.

The process can further include the step of rinsing the mixing tank with water after one of the preselected products has been formed and discharged from the tank. The water preferably comes from a water source at the use site.

The present invention includes a chemical delivery and on-site blending system for forming at a determined use site a plurality of preselected chemical products from a plurality of respective chemical subcomponents. The chemical subcomponents are fed to the system from a plurality of corresponding containment tanks. The system includes a plurality of inlet valves for respectively controlling the flow of a plurality of chemical subcomponents into the system. The valves drain into a common chemical feedline.

A chemical feed pump pumps predetermined measured amounts of the subcomponents from the chemical feed line into a mixing tank. A quantity monitoring means monitors the amounts of the chemical subcomponents entering the mixing tank. A mixing means mixes the subcomponents for a predetermined interval of time inside of the mixing tank for forming the chemical products.

The chemical delivery and on-site blending system can further include a central control means for automatically forming a user selected one of the plurality of preselected products by operating the plurality of inlet valves and allowing predetermined measured amounts of certain of the subcomponents to enter the feedline. The amounts are ascertained by receiving information from the quantity monitoring means. The central control means further operates the chemical feed pump and the mixing means in preselected and automated patterns for blending the subcomponents into one of the chemical products at the use site. The chemical products can be formed at the use site without having to deliver each of the products to the site individually.

The chemical delivery and on-site blending system can further include a water intake line connected to one of the plurality of inlet valves. The water can be used for blending with the subcomponents. Further, the chemical delivery and on-site blending system can include a water rinse line also connected to the plurality of inlet valves and emptying into the mixing tank. The rinse line can include a spray nozzle inside of the tank for rinsing the tank after the respective chemical products have been formed. The system can include a chemical exit line connected to the mixing tank, a chemical pump and an exit valve for discharging the chemical products from the tank. The chemical exit line can branch off into a plurality of discharge lines, each having a corresponding exit valve.

The quantity monitoring means included in the chemical delivery and on-site blending systems can include an electronic flow meter capable of electronically transmitting information or can include a load cell which measures the amounts of the subcomponents entering the tank by sensing weight differences in the tank. The mixing means can include a mixer or an agitator located within the tank. The central control means can include a programmable electronic control device incorporating a microprocessor for storing programs containing information for forming the chemical products. The electronic control device can include a control panel having a plurality of product select switches which respectively correspond to the plurality of preselected products for automatically forming the products when activated.

A method of forming a plurality of preselected chemical products from a plurality of respective chemical subcomponents includes utilizing the above-described chemical delivery and on-site blending system.

Another present exemplary embodiment concerns an automated chemical delivery and on-site blending system for forming a plurality of preselected chemical products at a determined use site. This system includes a plurality of product select switches on a user input control panel corresponding to a respective plurality of chemical products. A user need only activate one of the switches for automatically forming one of the respective products.

The chemical delivery and on-site blending system includes a plurality of containers for respectively holding a corresponding plurality of preselected chemical subcomponents for subsequent controlled blending into a plurality of respective chemical products that are selected by a user. The chemical subcomponents are generally in a chemically concentrated state. A water intake line supplies water to the system for controlled dilution of the chemical subcomponents. The water is preferably supplied from a water source at the site. A plurality of intake valves generally corresponding to the containers and to the water intake line controls the flow of the chemically concentrated subcomponents and the water during formation of the chemical products.

This system further includes a chemical feed pump for pumping predetermined measured amounts of the subcomponents and the water into a mixing tank and a means for monitoring the quantity of the subcomponents and the water entering the tank. A mixing means mixes the subcomponents and the water for a predetermined interval of time inside of the mixing tank, thereby forming a user selected one of the chemical products. A chemical exit line is connected to the mixing tank. A chemical exit pump and an exit valve are used for discharging the user selected chemical products from the tank for selective storage and use at the site. A programmable electronic device including a microprocessor electronically connected to the plurality of product select switches stores information for automatically forming the chemical products when the respective product select switches are user activated.

The foregoing chemical delivery and on-site blending system can include a water rinse line connected to the plurality of inlet valves and emptying into the mixing tank. The rinse line includes a spray nozzle inside of the tank for rinsing the tank after the chemical products have been formed and discharged. The chemical exit line can branch off into a plurality of discharge lines, each having a corresponding exit valve. Further, a drain line can be connected to the bottom of the tank, including a gravity drain valve for providing an alternate means for draining the tank.

In the above chemical delivery and on-site blending system, the plurality of containers for holding the respective chemical subcomponents can be stackable. In other embodiments, the containers define openings for receiving the tines of a forklift for safe and easy movement of the containers. The containers can be sized for efficient storage on trucks and railcars.

The quantity monitoring means described above can include a flow meter capable of transmitting electronic information to the programmable electronic device for measuring the controlled amounts of the chemical subcomponents and the water. The quantity monitoring means can also include a load cell which measures amounts of the chemical subcomponents entering the mixing tank by sensing weight differences in the tank. The mixing means can include a mixer located within the mixing tank.

As one example, the on site chemical blending system of the present invention is particularly applicable and useful to chemical suppliers of cleaners and cleaning solvents. For instance, products used to clean machines, equipment, parts, and processes typically contain common ingredients. Most of the ingredients include water, sodium hydroxide, sodium hypochlorite or bleach, along with a variety of detergents, surfactants and solvent cleaners. From these ingredients, suppliers can blend an infinite variety of products for use in varying applications. The blend used to formulate a particular product depends upon the object to be cleaned, the presence of other chemicals, the waste matter that is to be removed, and the conditions under which cleaning will occur. Sometimes these products will be tailored to an individual customer. And, depending upon the industry in which the customer is involved, the customer may need many different cleaning products for application to a variety of machinery or a variety of processes.

By using the chemical blending system, a chemical supplier need only transport the concentrated chemical subcomponents to the customer's facility. The chemical supplier does not have to transport each product individually. By supplying water to the system, the customer is not charged for transporting it. Therefore, a chemical supplier is transporting fewer chemical products to a customer and, with the deletion of water, is transporting a smaller overall quantity. Consequently, transportation and delivery costs are decreased. In fact, even the cost of liability insurance, which has dramatically increased for chemical distributors, is reduced.

Those of ordinary skill in the art will better appreciate the features and aspects of such embodiments, and others, upon review of the remainder of the specification.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
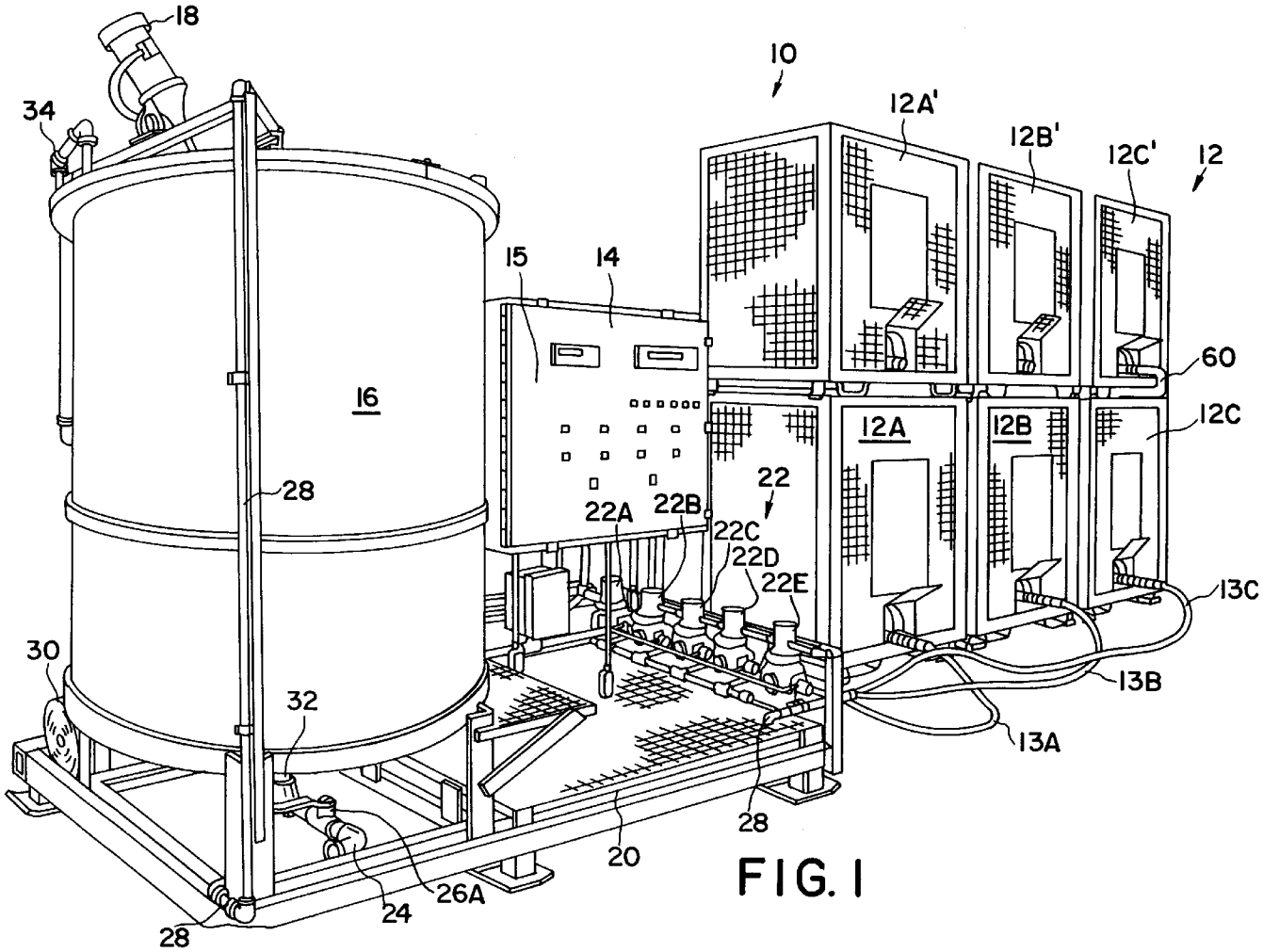
FIG. 1 is a perspective view of a chemical blending system in accordance with the present invention.

Repeat use of reference characters in the present specification and drawings is intended to represent same or analogous features or elements of the invention.

DETAILED DESCRIPTION OF PREFERRED EMBODIMENTS

It is to be understood by those of ordinary skill in the art that the present discussion is a description of exemplary embodiments, and is not intended as limiting the broader aspects of the present invention, which broader aspects are embodied in the exemplary construction.

Referring to FIG. 1, a preferred embodiment made in accordance with the present invention is illustrated. An on-site chemical blending system, generally 10, is shown. Blending system 10 includes a plurality of chemical subcomponent tanks, generally 12, which contain the chemical subcomponents used to make the various products. In this particular embodiment, six subcomponent tanks 12A, 12A', 12B, 12B', 12C and 12C' are shown stacked in pairs. One chemical subcomponent is stored in each pair of stacked tanks 12. Consequently, three subcomponents are fed to blending system 10 in the embodiment shown in FIG. 1. Although any size tank or reservoir could be used to feed chemicals to system 10, subcomponent tanks 12 are easy to move, lift and transport.

Figure 6:
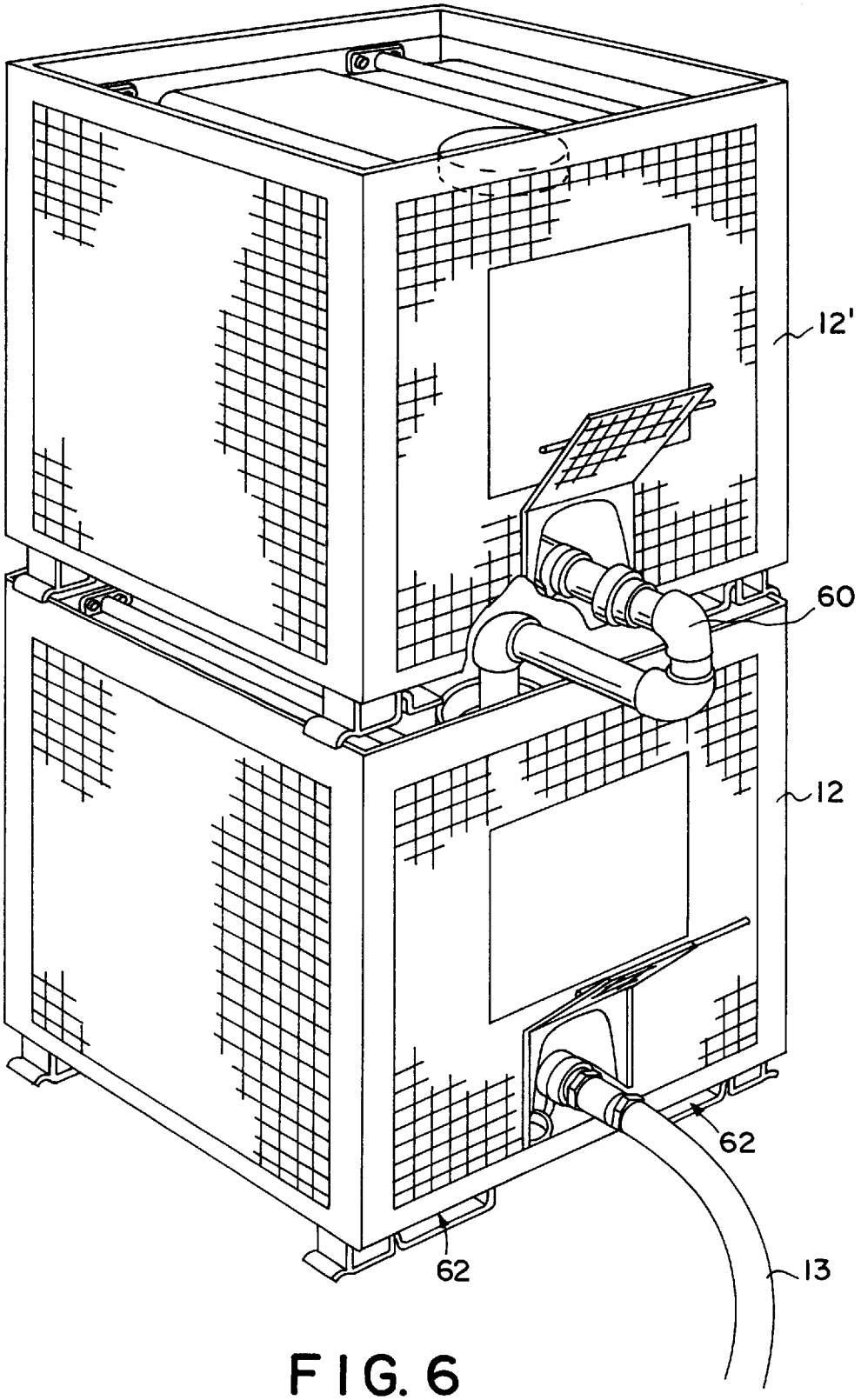
FIG. 6 is a perspective view of a pair of chemical subcomponent tanks in accordance with the present invention.

Referring to FIG. 6, a pair of subcomponent tanks 12 and 12' are shown stacked one on top of the other. Tanks 12 and 12' are designed to contain and feed a single chemical subcomponent to chemical blending system 10. Tank 12' drains into tank 12 by means of a connecting tube 60 while the chemical subcomponent is fed to blending system 10 through a feed hose 13. Consequently, when tank 12' is empty, it can be removed and replaced with a similar subcomponent tank full of the chemical ingredient. In this manner, bottom tank 12 is never completely empty and therefore can continuously feed chemical to blending system 10. The subcomponent tanks generally 12 can also be used for transporting the chemical ingredients to a customer's facility. The stackability of tanks 12 allows them to be efficiently spaced on a truck or rail car. Tanks 12 define channels 62 for receiving the tines of a forklift for providing a safe and efficient means for lifting and transporting the tanks. Also, subcomponent tanks 12 are equipped with an exterior metal screen for protecting its contents.

Referring back to FIG. 1, subcomponent tanks 12A, 12B and 12C drain into feed hoses 13A, 13B and 13C, respectively. Hoses 13A, 13B and 13C are connected to a series of inlet valves, generally 22. Specifically, feed hose 13A is connected to inlet valve 22A, feed hose 13B is connected to inlet valve 22B and feed hose 13C is connected to inlet valve 22C. The remaining valves 22D and 22E are connected to a water line usually provided on site by the customer.

Figure 3:
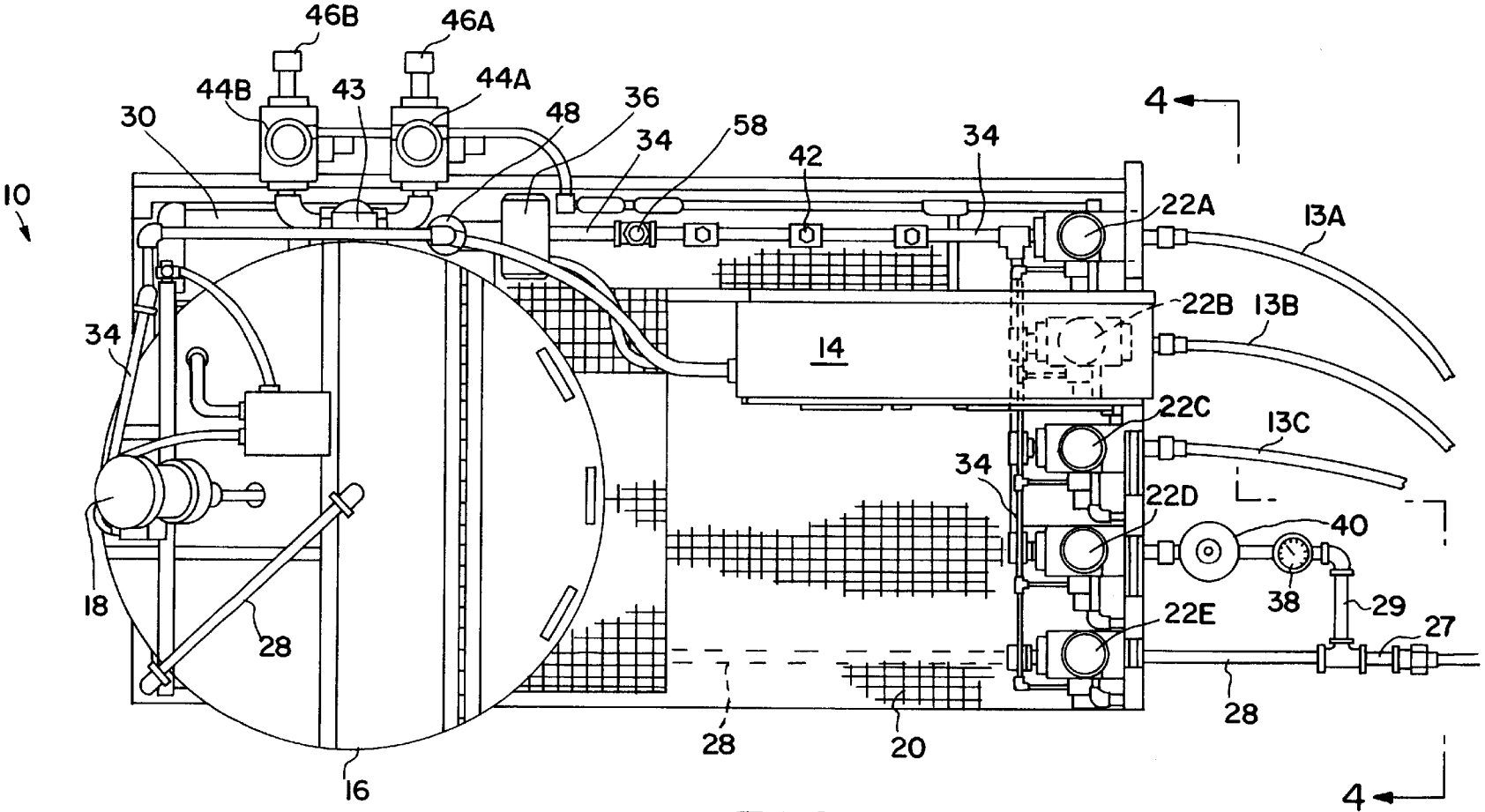
FIG. 3 is a top view of the chemical blending system as illustrated in FIG. 1.
Figure 4:
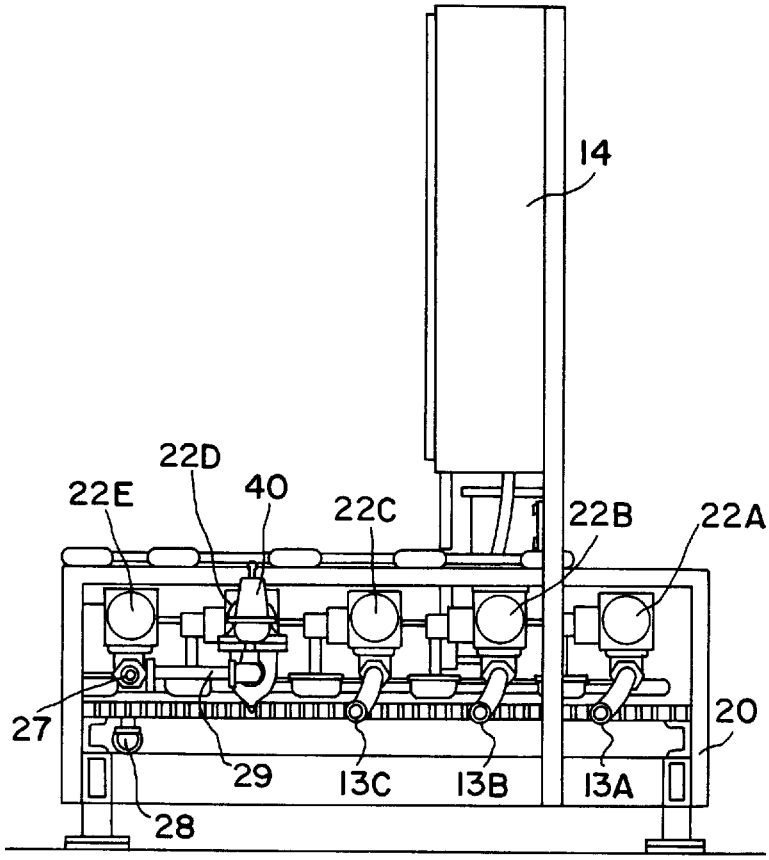
FIG. 4 is another side view of the chemical blending system illustrated in FIG. 1.

FIGS. 3 and 4 better illustrate the series of inlet valves 22. The purpose of valves 22 is to stop, start, and regulate the flow of the chemical subcomponents and the water feeding into blending system 10. Preferably, the opening and closing of valves 22 can be controlled by a microprocessor via an electrical connection. In one embodiment, valves 22 are solenoid valves integral with an actuator which can electronically control the position of the valve. Such valves are manufactured by El-O-Matic International, Hackensack, N.J. As shown in FIGS. 3 and 4 and as discussed above, inlet valves 22A, 22B and 22C are connected to feed hoses 13A, 13B and 13C, respectively, which supply the chemical subcomponents to blending system 10. Inlet valves 22D and 22E are connected to a water line 27 which is preferably supplied to blending system 10 from the facility where system 10 is to be used. As shown in FIG. 3, water line 27 branches off into a water rinse line 28 and a water feed line 29. Rinse line 28 is connected to inlet valve 22E and thereafter runs beneath a support base 20, ultimately emptying into the top of a mixing tank 16. In this arrangement, when valve 22E is open, water flows into and rinses mixing tank 16. Preferably, a tank washing nozzle is fitted on the end of rinse line 28 inside of mixing tank 16. Spray nozzles produce high speed sprays in multiple directions for rinsing the walls of a tank. The rinsing operation normally occurs after a product has been formulated and discharged.

Water line 27 also branches into water feed line 29 which is connected to inlet valve 22D. Water feed line 29 also includes a pressure gauge 38 and a pressure regulator 40 located before inlet valve 22D. Water feed line 29 supplies water to blending system 10 for blending with the chemical subcomponents. Consequently, it is important that the quantity of water entering mixing tank 16 be accurately measured when formulating a product. In order to more accurately measure the flow rate of the water, pressure regulator 40 ensures that water enters the system at a constant pressure and therefore at a constant flow rate. Pressure regulator 40 also ensures that water at a high pressure does not enter the system and damage any of the components. Pressure gauge 38 monitors the pressure of the incoming water. If the water pressure were too high, a different water source could be used or other control devices could be installed on water line 27.

Inlet valves 22A, 22B, 22C and 22D all drain into a common chemical feed line 34. From intake valves 22, feed line 34 runs down the length of support base 20 and ultimately empties into the top of mixing tank 16. In the particular embodiment illustrated in the figures, chemical blending system 10 has three chemical subcomponent feed lines, a water feed line and a rinse line. However, the chemical blending system of the present invention is capable of receiving as many additional feed lines as are necessary. For example, as shown in FIGS. 2 and 3, a series of connections 42 are included on chemical feed line 34 for further valve connections and therefore to accommodate several more chemical subcomponents.

Figure 2:
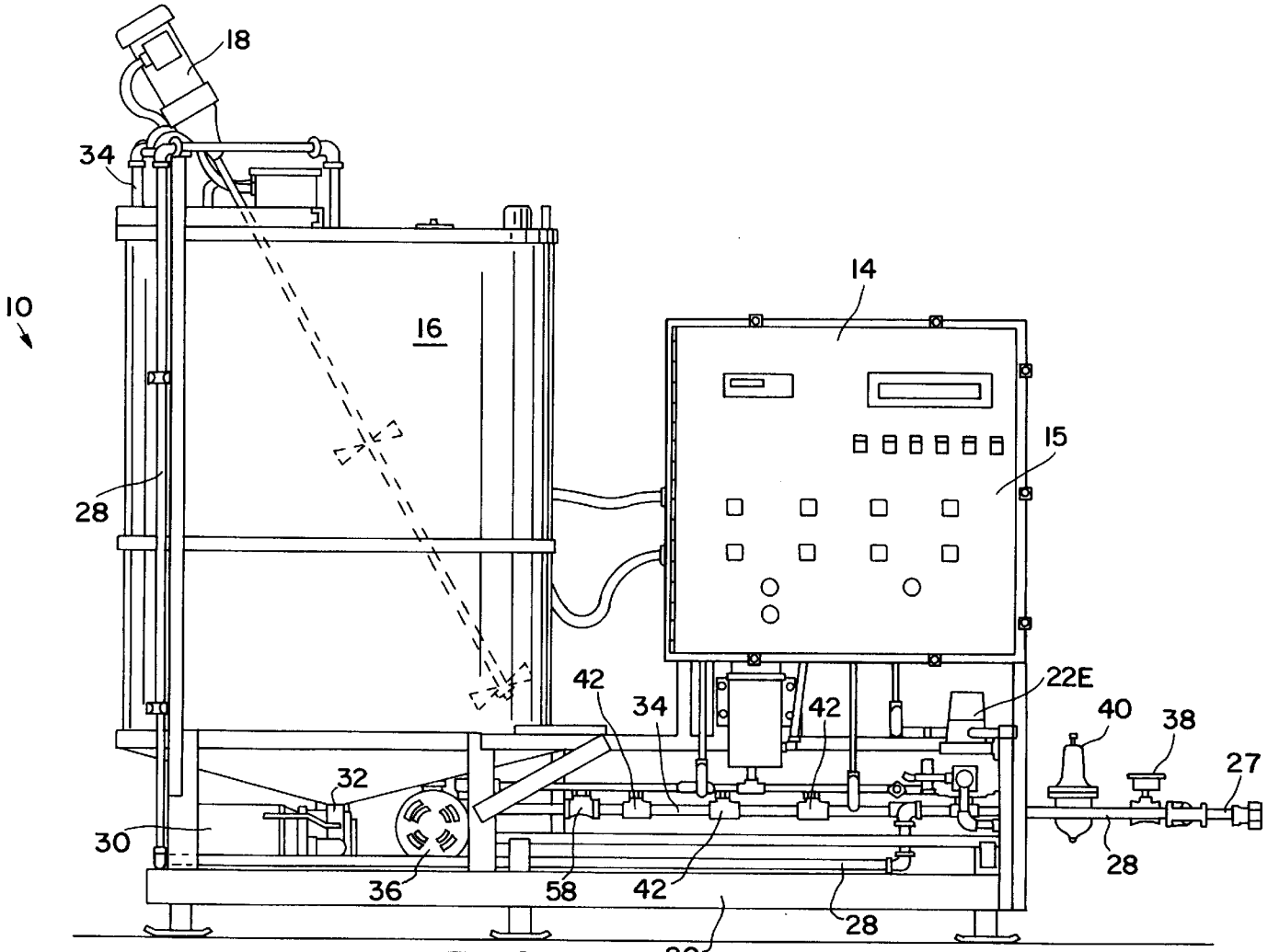
FIG. 2 is a side view of the chemical blending system as illustrated in FIG. 1.

Referring to FIGS. 2 and 3 and as stated above, the chemical subcomponents and water drain into chemical feed line 34. A feed pump 36 pumps the ingredients into mixing tank 16. In order to eliminate foaming of the product, feed line 34 preferably ends at the bottom of mixing tank 16. Therefore, the ingredients entering tank 16 do not splash against the tank walls or create excessive turbulence which would cause foaming. However, because feed line 34 ends at the bottom of tank 16, a check valve 58 is preferably installed along feed line 34. Check valve 58 prevents any backflow of product in feed line 34.

Check valve 58 can be located anywhere along feedline 34. In other embodiments, check valve can be located within tank 16. Also, two check valves can be incorporated into the system, one inside of tank 16 and the other as shown in the figures.

Along chemical feed line 34 is a flow meter 48 located after feed pump 36. When forming a product, each ingredient is fed to mixing tank 16 separately. Flow meter 48 measures the quantity or volume of each ingredient entering tank 16. Therefore, flow meter 48 acts as an indicator for determining when a desired amount of ingredient has been added. Preferably, flow meter 48 can send an electronic signal to a central processing unit or a microprocessor. When a specified amount of a particular ingredient has been added to mixing tank 16, the central processing unit will interpret that data from flow meter 48 and, in turn, close inlet valve 22 stopping the flow of the chemical ingredient. Thereafter, the next ingredient can be fed to mixing tank 16 following the same procedure. Flow meters of the type described above are sold by Krohne America, Inc., Peabody, Mass.

Although a flow meter is preferred, other devices can be employed to measure the quantity of ingredients entering mixing tank 16. For instance, a load cell could be installed. Instead of measuring the volume, a load cell measures the weight of the ingredient being added. Similar to a flow meter, a load cell could indicate when a desired quantity of an ingredient has been added to tank 16 by monitoring the weight change of the tank. However, by experimentation, it has been found that load cells are not as accurate as flow meters. Further, load cells are more delicate instruments. For instance, if anyone leaned on mixing tank 16 in order to look inside while a chemical ingredient was being fed, a load cell would register the outside force as part of the quantity of the added ingredient.

Besides a load cell, other means of measuring an ingredient being added to mixing tank 16 could include a bobber that measures the level of liquid in the tank as it increases. Also, a series of level indicators could be mounted on the inside of the tank wall indicating the level of the liquid. Tank 16 could even be made from a see-through material and the tank level could be monitored manually. However, the most precise and preferred method is to use a flow meter. Precision is normally very crucial when formulating a chemical product.

As stated above, the ingredients of a particular product are added and blended in tank 16. Mixing tank 16 preferably is cylindrical in shape. For instance, if tank 16 were square, it would take longer to adequately mix a product; the corners of square tanks tend to create slower flow regions. The size of mixing tank 16 can vary depending upon the amount of product needed to be formulated in a single batch. Typically, a 500 gallon tank would be adequate. Also, mixing tank 16 is preferably covered so that the product is contained within the tank during mixing.

In order to mix the ingredients after they have been added to tank 16, an agitator 18 has been mounted on top of tank 16. Agitator 18 consists of an electric motor that rotates a shaft with propellers mounted thereon. As the propellers rotate, the solution is mixed. Such agitators are distributed by Neptune Mixer Company, Lansdale, Pa. Of course, there are many other means for mixing the products. For instance, if mixing tank 16 were of a smaller size, the whole tank could be shaken. As another example, a propeller could be mounted on the bottom of tank 16 and rotated by a motor.

On the bottom of mixing tank 16 is an exit line 32 as shown in FIGS. 1 and 2. Exit line 32 branches off in two directions forming a gravity drain line 24 as shown in FIG. 1 and a pump line 43 as shown in FIG. 3. Pump line 43 branches off again into discharge lines 46A and 46B. The flow in discharge lines 46A and 46B is controlled by discharge valves 44A and 44B, respectively. Discharge valves 44A and 44B can be the same type of valve as inlet valves 22, only rated for higher flow rates.

When a product has been blended in mixing tank 16 or after a rinse cycle has been completed, the solution in mixing tank 16 is discharged by turning on a discharge pump 30 and pumping the solution out one or both of discharge lines 46A and 46B. It is not necessary that two discharge lines exist. However, by having two or more discharge lines, a user of chemical blending system 10 can direct the flow of a blended product or rinse to different destinations without having to switch connections or move lines. For instance, in the embodiment shown in FIG. 3, a product could be pumped out discharge line 46A for use in plant operations. Thereafter, the rinse could be pumped out discharge line 46B and discarded while the product that was pumped out line 46A was in use. Also, if desired, a product could be pumped out lines 46A and 46B simultaneously in order to service two different plant systems. Overall, the number of discharge lines included within a particular system 10 will depend upon the number of blended products being fabricated and the customer's needs.

Figure 7:
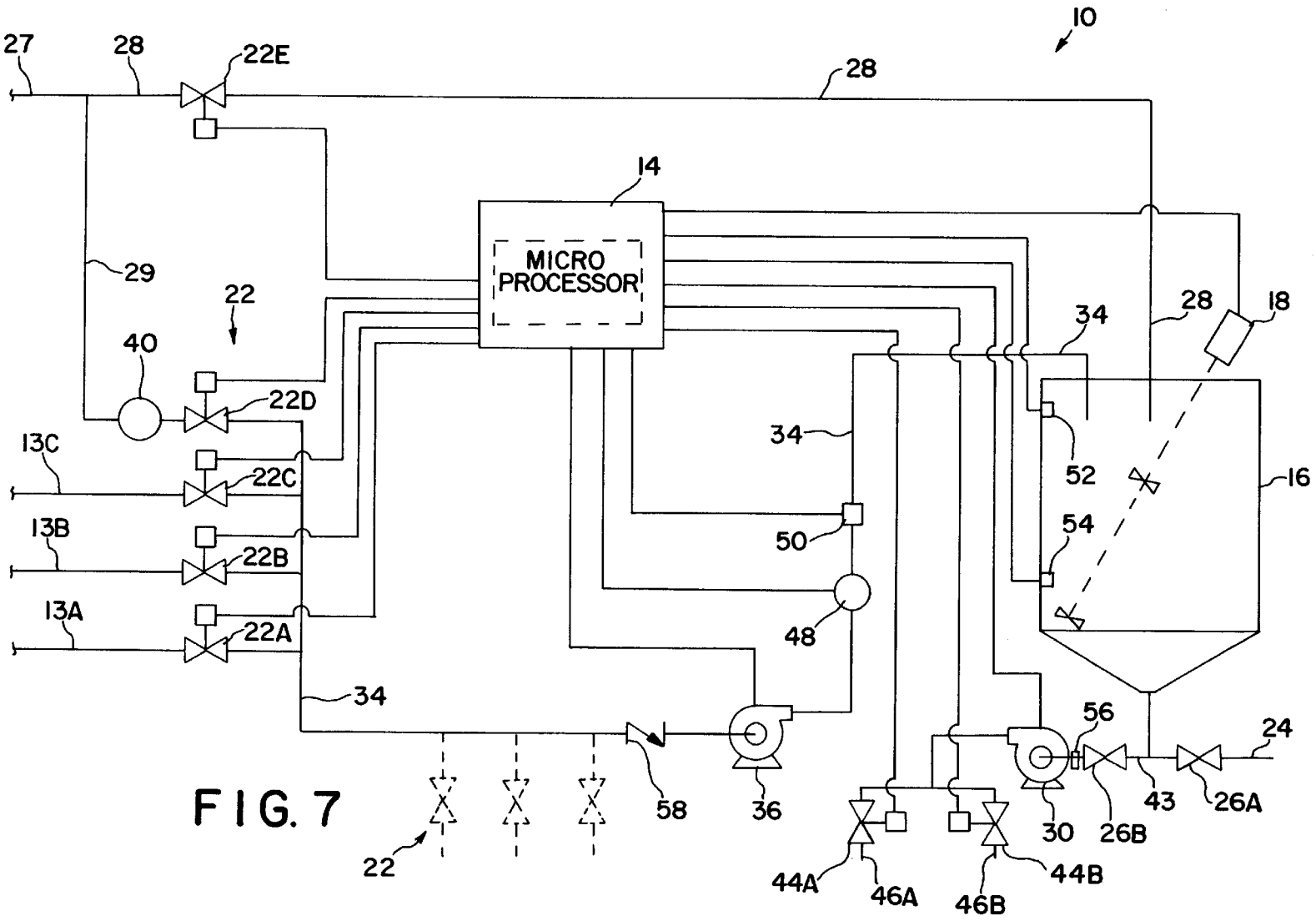
FIG. 7 is a plan view of the chemical blending system according to the present invention.

In order to assist in automating the discharge process, pump line 43 includes a flow switch 56 not shown in FIG. 3 but represented in FIG. 7. Generally, a flow switch operates automatically to protect equipment and pipeline systems against damage from reduction or loss of flow. When detecting flow, flow switch 56 forms a circuit thereby emitting an electrical impulse. In the absence of flow, the circuit is broken. When flow switch 56 does not detect flow, discharge pump 30 is turned off thereby protecting it. Also, flow switch 56 is an indicator of when mixing tank 16 is empty.

Also represented in FIG. 7 are two tank level indicators 52 and 54 inside of mixing tank 16. Level indicators 52 and 54 monitor the liquid level inside of tank 16. Top level indicator 52 determines when tank 16 is full, acting as a check and balance for flow meter 48. If the liquid level were to reach top level indicator 52, chemical blending system 10 would automatically stop feeding ingredients to tank 16 to prevent overflow.

Bottom level indicator 54 works in conjunction with flow switch 56 for determining when tank 16 is empty. Bottom level indicator 54 is a check and balance to flow switch 56. In fact, bottom level indicator 54 is a more precise device for determining when mixing tank 16 is empty. Specifically, when flow switch 56 is not registering flow and when bottom level indicator 54 determines that tank 16 is empty, blending system 10 closes drain valves 44A and 44B and ceases discharging operations.

As described above, exit line 32 also feeds into a gravity drain line 24. As shown in FIG. 1, gravity drain line 24 includes a hand valve 26A. Therefore, in this embodiment, drain line 24 can only be operated manually. Gravity drain line 24 allows the user of chemical blending system 10 the option of draining mixing tank 16 without using discharge pump 30. Line 24 is normally not used during operation of blending system 10. However, in case of power failure or a malfunction, back-up drain line 24 could be used. Also, if more discharge lines were needed on mixing tank 16, another discharge pump could be installed, thereby turning drain line 24 into a discharge line similar to pump line 43.

Represented in FIG. 7, a hand valve 26B can also be placed on pump line 43. Hand valve 26B acts merely as a maintenance device for stopping the flow out pump line 43 in case discharge pump 30 or discharge valves 44A and 44B need servicing or in case other problems arise.

Referring to FIG. 1, blending system 10 includes a support base 20. Mixing tank 16, pumps 30 and 36, inlet valves 22, discharges valves 44A and 44B, agitator 18 and all piping and piping components are supported or mounted on support base 20. Further, a microprocessor 14, which can automatically control all operations of blending system 10, is attached to base 20. Consequently, besides subcomponent tanks 12, the entire blending system 10, can be lifted and transported as a single consolidated unit. Such mobility allows blending system 10 to conveniently be delivered to a customer's facility for on-site blending of products.

FIG. 7 is a plan view of a fully automated chemical blending system 10. A microprocessor 14 receives signals from all electrical equipment and controls the operation of inlet valves 22, feed pump 36, agitator 18, discharge pump 30, and discharge valves 44A and 44B. When formulating a product, microprocessor 14 will open one of the inlet valves 22 and feed an ingredient into feed line 34. Microprocessor 14 will turn feed pump 36 on and pump the ingredient into mixing tank 16. Flow meter 48 will send a signal to microprocessor 14 indicating the amount of the ingredient being fed. When a desired amount of the chemical ingredient has been added, microprocessor 14 will close the inlet valve 22 and begin feeding another ingredient in the same manner. When all of the ingredients or a substantial amount of the ingredients have been added to tank 16, microprocessor 14 activates agitator 18 and begins mixing the solution for a predetermined amount of time. During this time, if the water level in tank 16 were to rise to top level indicator 52, microprocessor 14 would automatically discontinue feeding any chemical ingredients.

Once the product has been formulated and mixed inside of mixing tank 16, microprocessor 14 opens one or both of discharge valves 44A and 44B and activates discharge pump 30. The product is then pumped to a holding tank or directly into a chemical process. Flow switch 56 and bottom level indicator 54 indicate when mixing tank 16 is empty. Microprocessor 14 then turns off discharge pump 30 and closes discharge valves 44A and 44B.

If desired, mixing tank 16 can be rinsed after a product has been discharged. Microprocessor 14 opens inlet valve 22E thereby opening the flow of water into tank 16. As discussed above, rinse line 28 is equipped with a spray nozzle which sprays rinse water on all sides of tank 16. Inlet valve 22E remains open for a predetermined amount of time. The rinse water can then be discharged to a waste stream or to the sewer by opening discharge valve 44A or discharge valve 44B and activating discharge pump 30. Once the rinse water has been emptied, microprocessor 14 turns discharge pump 30 off and closes discharge valve 44A or 44B.

Chemical blending system 10 of FIG. 7 also contains an optional flow switch 50 located after flow meter 48. Flow switch 50 would indicate whether or not there was flow in feed line 34. If no flow were registering, microprocessor 14 would turn feed pump 36 off in order to prevent damage to the pump. However, flow meter 48 can also be used to determine whether there is flow in feed line 34.

Figure 5:
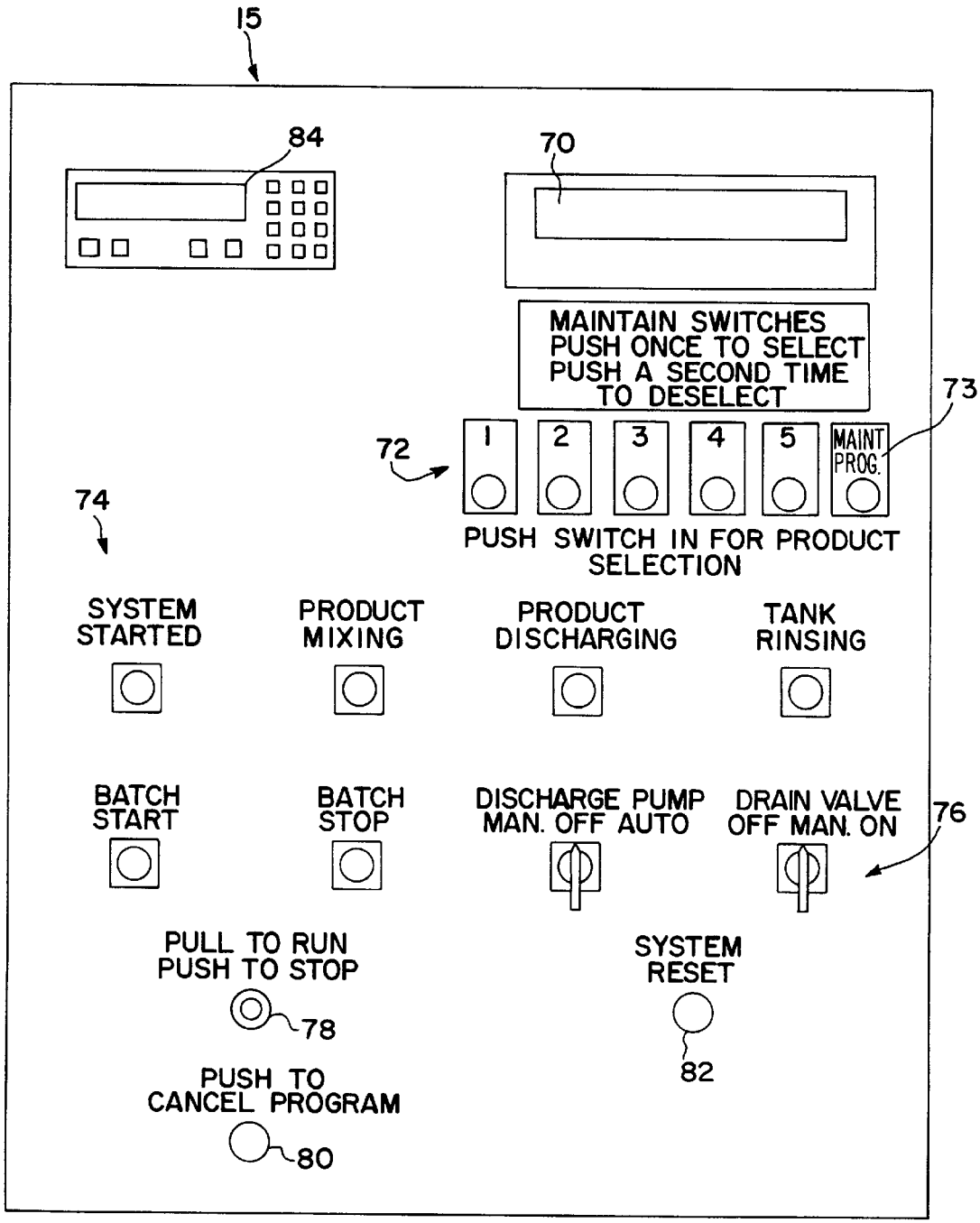
FIG. 5 is a plan view of a control panel used in the chemical blending system of the present invention.

As shown in FIGS. 1 and 2, microprocessor 14 includes a control panel 15 which is illustrated in FIG. 5. Control panel 15 has a plurality of product selection switches, generally 72. Each numbered button corresponds to a particular product. If a customer wanted to produce a product, one of product selection buttons 72 would be activated. When a stop and start button 78 is pulled, chemical blending system 10 would begin making the selected product. While the product is being formulated, a plurality of illuminated panel lights, generally 74, on control panel 15 will indicate at what stage product production is in. Specifically, panel lights 74 include a "system started" light, a "product mixing" light, a "product discharging" light, a "tank rinsing" light, a "batch start" light and a "batch stop" light. Also, on control panel 15 is a display 70. Display 70, in printed form, transmits to the user information about blending system 10. For instance, display 70 can give directions for using system 10 and, more particularly, for using panel 15. Display 70 might tell the user which buttons to push at a particular time. Also, display 70 can indicate the operation being performed and the time it will take for completion.

In the particular embodiment shown, there are five different product selection buttons 72. However, microprocessor 14 is capable of being programmed to formulate many more products than just five. Consequently, the number of product selection buttons 72 appearing on control panel 15 depends upon the number of products a particular customer desires.

Next to product selection button 72 is a "maintenance program" button 73 which is an optional feature to blending system 10. Button 73, when activated, runs a maintenance program on blending system 10. The maintenance program consists of circulating water through the system so the system components do not become corroded from residue left by the chemical products. Specifically, inlet valve 22D is opened allowing water to enter feed line 34, through feed pump 36, into tank 16 and out any discharge lines 46A and 46B. The program runs on a predetermined timed schedule.

Also included on control panel 15 are a pair of manual override switches controlling discharge pump 30 and drain valves 44A and 44B. Switches 76 allow for manual operation of the designated instruments. For instance, switch 76 controlling the discharge pump can be put in the "off" position preventing operation of discharge pump 30. If switched to the "auto" position, microprocessor 14 will be in control of activating discharge pump 30. If switch 76 were put in the "manual" position, discharge pump 30 could be turned on and off with a manual switch. Manual drain valve switch 76 works in the same manner. Switches 76 were installed to anticipate times where manual operation of the equipment would be necessary. Generally, it is desirable not to leave total control of some equipment with microprocessor 14. Thus, more manual override switches may be installed on control panel 15 depending on a customer's needs.

Once a selection has been made on control panel 15, it is possible to stop or cancel the preselected program. First, start and stop button 78 can be pushed in to stop a started process. The process can be continued by pulling button 78. This feature is important when, for instance, a problem exists in the system which needs to be corrected before any desired products are made. On the other hand, a process can be cancelled by pushing a "cancel" button 80. Control panel 15 further contains a system reset button 82. If, for instance, microprocessor 14 sensed a malfunction and shut down a process, once the malfunction was corrected, button 82 would be depressed and the process would start up again from where it was stopped.

The last feature on control panel 15 is a flow meter display 84. Display 84 consists generally of a display screen and a keypad. Not to be used by the customer, display 84 is primarily a maintenance item for programming flow meter 48.

EXAMPLE 1

As mentioned above, chemical blending system 10 of the present invention is particularly applicable for use by chemical suppliers of cleaners and cleaning solvents. For purposes of illustration only in the poultry processing industry, a typical plant may require several cleaning products for use on different machinery and in different applications. Currently, a particular poultry processing plant is capable of using eight different cleaning products made from five chemical subcomponents and water. Specifically, the subcomponents are:

1) sodium hydroxide;
2) sodium hypochlorite or bleach;
3) a mixture of detergents and surfactants;
4) alkaline builder; and 5) a solvent cleaner.

The mixture of detergents and surfactants includes sodium xylene sulfonate which is a surfactant coupling agent, a linear ethoxylated alcohol sold under the trade name ETHAL LA-12, a polyalkene which is an anionic surfactant sold under the trade name TRITON, a linear alkyl sulfonate sold under the trade name DDBSA, and sodium hydroxide. Also, the alkaline builder is a silicate while the solvent cleaner is glycol ether.

From these five chemical subcomponents and with the addition of water, an infinite number of chemical cleaning products can be made. In fact, even though a particular customer may only be using eight or nine products made from the subcomponents, chemical blending system 10 is fully capable of being reprogrammed to modify existing products or to formulate new ones. However, the following products are currently being made from the above-listed subcomponents and water:

Product No. 1

Water 33 Gallons

Sodium Hydroxide 39 Gallons

Sodium Hypochlorite 25 Gallons

Alkaline Builder 3 Gallons

Product No. 2

Water 46 Gallons

Mixture of Detergents 16 Gallons and Surfactants

Sodium Hydroxide 18 Gallons

Sodium Hypochlorite 18 Gallons

Alkaline Builder 2 Gallons

Product No. 3

Water 41 Gallons

Mixture of Detergents 26 Gallons and Surfactants

Sodium Hydroxide 31 Gallons

Alkaline Builder 2 Gallons

Product No. 4

Sodium Hydroxide 70 Gallons

Sodium Hypochlorite 20 Gallons

Alkaline Builder 10 Gallons

Product No. 5

Sodium Hydroxide 75 Gallons

Water 15 Gallons

Alkaline Builder 10 Gallons

Product No. 6

Water 63 Gallons

Sodium Hydroxide 2 Gallons

Mixture of Detergents 7 Gallons and Surfactants

Alkaline Builder 20 Gallons

Solvent Cleaner 8 Gallons

Product No. 7

Water 71 Gallons

Sodium Hydroxide 13 Gallons

Solvent Cleaner 4 Gallons

Alkaline Builder 12 Gallons

Product No. 8

Water 50 Gallons

Solvent Cleaner 4 Gallons

Sodium Hydroxide 36 Gallons

Mixture of Detergent 10 Gallons and Surfactants

Consequently, only 5 subcomponents need to be delivered to a customer who is using eight different products. Also, the water added to the products is supplied by the customer on site, reducing delivery costs even more.

EXAMPLE 2

Besides use in the poultry processing industry, the chemical blending system and process of the present invention are also particularly well suited for application to the papermaking industry. In the papermaking industry, many various chemical products are needed to serve a variety of purposes. One group of these chemical products relates to solutions used to treat the equipment that produces the paper. Many advantages can be realized by using the chemical blending system of the present invention as will be described hereinafter.

In a typical papermaking process, fibers, such as wood fibers, are combined in an aqueous suspension, pressed into sheets and dried to form a paper product. In general, a conventional papermaking machine is divided into three primary sections, namely a sheet forming section, a press section, and a drying section. In the sheet forming section, the aqueous dispersion of paper fibers is propelled out of a head box onto a porous forming fabric or "wire." Once cast on the wire, water contained within the aqueous dispersion is filtered through the fabric and removed, leaving the fibers in sheet form. In other words, initial formation of the paper sheet occurs in the sheet forming section.

In the second section of a papermaking machine, called the press section, the sheet is transferred to another porous fabric called the "felt." While in contact with the felt, the sheet moves through one or more press rolls or pressure nips for removal of most of the remaining water from the sheet. The press section improves sheet uniformity and imparts surface quality to the sheet.

From the press section, the sheet then moves to the drier section where the now low moisture paper sheet or web encounters a series of heated drier cylinders with drier fabrics therearound to further remove moisture from the web. The drier section dries the paper which then may be further processed into the finished paper product.

In each of the sheet forming section, the press section, and the drying section, a fabric or felt of some sort is employed to both support the sheet being formed and to facilitate removal of water therefrom. However, deposits of organic and inorganic materials can build up on these fabrics during processing. In particular, the aqueous dispersion of fibers used to make the paper can include a variety of dissolved or suspended materials including glues, resins, gums, inks, latex, plus a variety of other components. Once these substances begin to deposit upon the fabric and other machinery, the efficiency of the system is severely reduced, along with the quality of the resulting product. As such, there is a need to constantly clean various components of the papermaking process.

For instance, in the sheet forming section, the fabric or wire is typically treated with a solution that acts as a wetting agent. The fabric becomes hydrophilic for promoting the separation of water from the aqueous dispersion of fibers. The solution can also be designed to prevent any glue-like substances from adhering thereto.

Also in the sheet forming section, it is important to periodically clean the headbox which propels the aqueous dispersion onto the wire. For example, the internal features of the headbox, including pumps and screens located within the system, can be periodically cleaned with an alkaline or an acid solution. The solution can be heated and allowed to soak within the headbox for a predetermined interval of time. The solution is generally referred to as a boil-out formulation and, besides having other purposes, is used generally to flush out and dissolve any contaminants within the system. Failure to clean the headbox can lead to defects in the sheet.

Besides using a boil-out solution, it is also important to periodically clean the headbox with scale control chemicals. In particular, scale deposits of calcium carbonate, barium sulfate and bacteria can develop within the headbox. Such scale deposits can reduce the diameter of various piping sections and can interfere with flow patterns of the fiber dispersion.

Besides the sheet forming section, the press section of a papermaking machine must also be continually treated with cleaning solutions and solvents. As described above, the press section is comprised of a press felt onto which the sheet is moved and pressed for removing moisture from the sheet. Because of the pressing operation, the buildup of deposits upon the felt is a major concern and a primary obstacle to efficient papermaking. As such, the felt is preferably continuously showered with a cleaning solution that opens the pores of the felt and dewaters the fabric. In particular, acid or alkali formulations blended with other chemicals, such as surfactants and solvents, have been used to remove and prevent the buildup of deposits.

Figure 8:
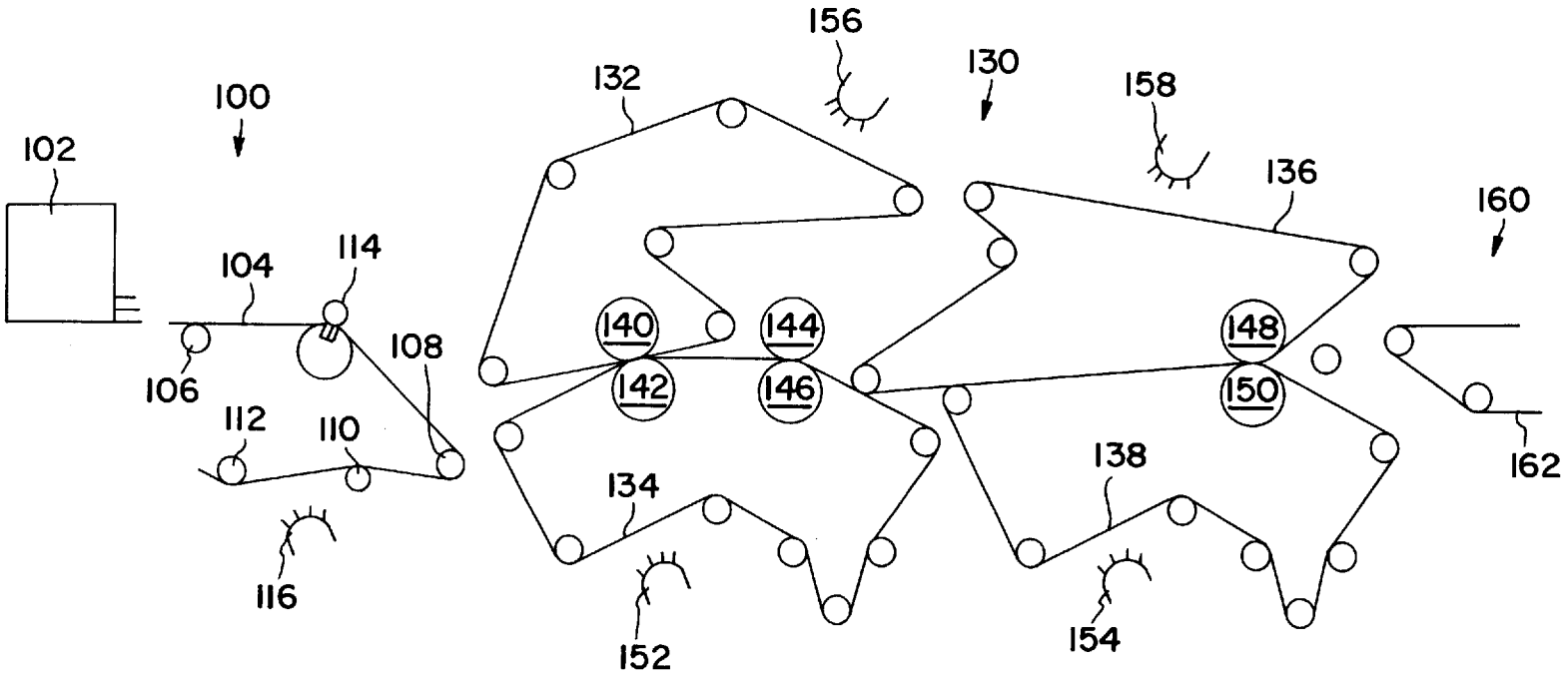
FIG. 8 is a plan view of a papermaking process for use with the present invention.

Referring to FIG. 8, a simplified drawing represents basic components used in a papermaking process. Complete details thereof are well known to those of ordinary skill in the art of papermaking, and form no particular part of the present invention subject matter. Included within the process components are a sheet forming section generally 100, a press section generally 130, and a drying section generally 160. Sheet forming section 100 includes a headbox 102 and a forming fabric or wire 104 in which only a partial section is shown. Headbox 102 includes multiple jets which receive the aqueous dispersion of fibers and form a sheet onto wire 104. Wire 104 is typically in the form of an endless belt positioned around exemplary guide rolls 106, 108, 110, and 112. Also included is a pressure bearing roll 114 for smoothing out the formed sheet.

Below wire 104 is a spray nozzle 116 for continuously spraying a wire cleaner onto the fabric. As described above, preferably the wire cleaner acts as a wetting agent on the fabric.

Referring to press section 130, in this exemplary embodiment, four different felt loops are shown, including a first felt 132, a second felt 134, a third felt 136, and a fourth felt 138. Each felt is in the form of an endless belt positioned around various guide rolls. In order to apply pressure to the formed sheet, press section 130 includes three pairs of nip rolls. Specifically, included for example are first nip rolls 140 and 142, second nip rolls 144 and 146, and third nip rolls 148 and 150. The nip rolls, working in respective pairs, press out most of the remaining moisture within the sheet.

In order to remove and prevent the buildup of deposits on the felts, press section 130 may also include four spray nozzles 152, 154, 156, and 158 for spraying a felt cleaner onto the four corresponding felts. Preferably, the felt cleaner is applied continuously to the fabric. As shown in the figure, the spray nozzles can be located to contact the felt at a location that will not interfere with the papermaking process.

Once the sheet paper leaves press section 130, it enters drying section 160. As described above, drying section 160 can include a series of heated cylinders to further remove moisture from the web. As shown, drying section 160 includes a dryer fabric 162 which can also be treated with a cleaning solution if desired.

Currently, in order to supply the various cleaning agents and products that are needed to clean the various machinery in the papermaking process, papermakers typically possess a number of large chemical holding tanks at each use site. A separate large holding tank must be included for each chemical product that is used on the system.

Besides the many disadvantages previously discussed with respect to large holding tanks, papermakers have also experienced other unique problems. For instance, at least a portion of these tanks is usually left open to the environment. Such practice, while perhaps desirable for certain reasons, on the other hand, allows various debris and contaminants to fall within the tank. For instance, dust, paper fibers, and any other airborne debris can fall into the tank, contaminate the chemical, and create a sludge on the bottom. If the sludge is not removed, it can interfere or react with the chemical being stored. However, in order to remove the sludge, tanks have to be drained and cleaned, which also means that production of paper usually must be discontinued.

Another disadvantage associated with large chemical holding tanks in the papermaking industry is that the chemical product being held must include an emulsifier or coupling agent in order prevent the chemical composition from separating into its individual components. When using large chemical holding tanks, it is anticipated that at least some portion of the chemical will be stored for an extended period of time before being used. The addition of such emulsifiers and coupling agents increases the cost of the chemical and the cost of its transportation.

Similar to circumstances in the poultry processing industry (Example 1, above), the multitude of chemical cleaners that are needed in conventional papermaking processes include common ingredients. However, such products are typically supplied individually from various suppliers instead of being consolidated in accordance with the present invention.

By using the chemical blending system of the present invention to supply cleaning products for use in a papermaking process, many of the above-described deficiencies and drawbacks of prior art methods can be alleviated. As described above, by using the chemical blending system of the present invention, a variety of chemical subcomponents can be supplied to a papermaking manufacturer for later blending into a plurality of chemical products. By using the present invention, chemical turnover rates are much higher, thereby reducing the infiltration of contaminants into the chemical supply. Also, the need to use emulsifiers and coupling agents is eliminated or reduced. For purposes of illustration only, a typical papermaking plant may require several cleaning products for use in the various machinery and fabric. Four examples of cleaning products used in the papermaking process include:

(1) a forming wire cleaner;

(2) a felt cleaner;

(3) a boil-out formulation; and (4) a scale control agent.

Again, such chemical products are used to clean the head box and the various types of fabrics used to make paper.

In one embodiment, using the blending system of the present invention, the above-listed products can be made from appropriately selected mixtures of the following chemical subcomponents:

(1) sodium hydroxide;

(2) sulfuric acid;

(3) a mixture of detergents and surfactants; and (4) a mixture of polyphosphates and sodium polyacrylates.

In particular, the mixture of detergents and surfactants can include, but is not limited to, linear alcohols, linear ethoxylated alcohols, nonyl phenol ethoxylates, salts of fatty acids, quaternary ammonium compounds, nonionic synthetic surfactants and anionic synthetic surfactants.

From such chemical subcomponents and with the addition of water supplied on site, a very large number of chemical cleaning products can be made including the above-listed products. Also, the products can be made in varying strength. For illustrative purposes only, the above-listed chemical products (in 100 gallon batches) can be made as follows from the above-listed subcomponents and water:

1. Forming Wire Cleaner:

water 55.45 gallons sodium hydroxide 0.55 gallons detergents and 44.00 gallons surfactants Felt Cleaner:

water 45 gallons sulfuric acid 10 gallons detergents and surfactants 45 gallons

Boil-Out Formulation:

water 20 gallons sodium hydroxide 50 gallons detergents and surfactants 30 gallons Scale Control Agent:

water 75 gallons polyphosphate and sodium polyacrylate mixture 25 gallons

Besides the above chemical subcomponents, other chemical agents may be included to the products. In particular, other cleaning solvents may be included within the fabric cleaners. Such cleaning solvents may include mixtures of glycol ethers, high flashpoint aliphatic and aromatic petroleum solvents, D-limonene and other naturally occurring solvents such as terpenes. Also, a defoaming agent can be included within the list of chemical subcomponents.

In another embodiment of the present invention, it may be more convenient to supply a chemical subcomponent on a dry basis rather than in a liquid form. In particular, some polymers as would be used to make products for use in the papermaking industry are sold as powders. In this embodiment, the subcomponent tank used to house the dry subcomponent can be placed upon a digital scale. A pump for solid materials such as a vacuum can be used to pump the subcomponent into the mixing tank. The digital scale can then monitor the weight change and supply the information to the microprocessor via an electric signal.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. An automated method of forming a plurality of preselected chemical cleaning products for use in treating machinery used to manufacture paper products, said method includes utilizing a programmable, electrical processing means having a control panel, said control panel including a plurality of product selection switches which upon activation initiates formation of a corresponding on-site chemical cleaning product, said method comprising the steps of:

supplying to a determined use site a plurality of preselected respective chemical subcomponents, said subcomponents generally being in a chemical concentrated state and including at least an alkaline solution, an acidic solution, and a detergent composition;

feeding predetermined measured amounts of certain of said subcomponents into a mixing tank upon activation of at least one of said product selection switches;

mixing said measured amounts of said subcomponents for a predetermined interval of time for forming a predetermined one of said respective chemical cleaning products;

discharging said on-site formed chemical cleaning product from said mixing tank for storage and use of said on-site chemical cleaning product to treat said machinery used in the manufacture of paper products at said site.

2. The method of claim 1, further comprising the step of feeding a predetermined measured amount of water into said mixing tank with said respective chemical subcomponents, said water coming from a water source at said site.

3. The method of claim 1, wherein quantities of on-site formed chemical cleaning products capable of being formed exceed quantities of said respective chemical subcomponents transported to said use site.

4. The method of claim 1, wherein said on-site formed chemical cleaning product is selected from the group consisting of a felt cleaner, a forming fabric cleaner, and a boil-out formulation for cleaning a headbox.

5. The method of claim 1, wherein said chemical subcomponents include a composition of polyphosphates and sodium acrylates useful in the formation of a scale control composition.

6. The method of claim 1, wherein said on-site formed chemical cleaning product is substantially free of chemical agents added solely for the purpose of acting as emulsifiers.

7. The method of claim 1, wherein at least one of said chemical subcomponents is supplied to said site in dry form.

8. The method of claim 1, wherein at least one of said chemical subcomponents is fed to said mixing tank in dry format.

* * * * *